US010753588B2

(12) United States Patent
Halliwell

(10) Patent No.: US 10,753,588 B2
(45) **Date of Patent: *Aug. 25, 2020**

(54) LINEAR LED LAMP TUBE WITH INTERNAL DRIVER AND ONE OR MORE ELECTRICALLY ISOLATED PINS

(71) Applicant: Feit Electric Company, Inc., Pico Rivera, CA (US)

(72) Inventor: Brian Halliwell, Pico Rivera, CA (US)

(73) Assignee: Feit Electric Company, Inc., Pico Rivera, CA (US)

( * ) Notice: Subject to any disclaimer, the term of this patent is extended or adjusted under 35 U.S.C. 154(b) by 123 days.

This patent is subject to a terminal disclaimer.

(21) Appl. No.: 16/036,518

(22) Filed: Jul. 16, 2018

(65) Prior Publication Data

US 2018/0328576 A1 Nov. 15, 2018

Related U.S. Application Data

(63) Continuation of application No. 15/133,732, filed on Apr. 20, 2016, now Pat. No. 10,047,939, which is a (Continued)

(51) Int. Cl.
*F21V 23/00* (2015.01)
*F21V 27/02* (2006.01)

(Continued)

(52) U.S. Cl.
CPC ..... *F21V 23/001* (2013.01); *F21K 9/27* (2016.08); *F21V 23/009* (2013.01); *F21V 23/06* (2013.01);

(Continued)

(58) Field of Classification Search
CPC ..... F21V 23/001; F21V 23/009; F21V 23/06; F21V 27/02; F21V 31/005; F21V 31/00;

(Continued)

(56) References Cited

U.S. PATENT DOCUMENTS 7,049,761 B2 5/2006 Timmermans et al.
7,507,001 B2 3/2009 Kit (Continued)

FOREIGN PATENT DOCUMENTS

JP 03119578 U 3/2006
WO WO 2008/141343 A1 11/2008
WO WO 2011/117059 A1 9/2011

OTHER PUBLICATIONS

United States Patent and Trademark Office, Notice of Allowance for U.S. Appl. No. 13/961,230, dated Jan. 11, 2016, 8 pages, USA.

(Continued)

*Primary Examiner* — Cara E Rakowski
*Assistant Examiner* — Hana S Featherly
(74) *Attorney, Agent, or Firm* — Alston & Bird LLP

(57) ABSTRACT

In various embodiments, a light emitting diode (LED) tube lamp is provided along with a method of installing the LED tube lamp into a lighting fixture. In various embodiments, the LED tube lamp comprises: a tube; at least one LED positioned within the tube; and a passage formed through at least a portion of the tube, the passage configured to receive there-through a set of electrical connecting wires, wherein a first end of the electrical connecting wires comprises at least one of a two- or three-prong polarized plug. Various embodiments may further comprise a driver circuit positioned within the tube, the driver circuit comprising a second end of the electrical connecting wires. In various embodiments, the LED lamp tube may further comprise at least one end cap disposed on an end of the tube and at least one pin secured thereon wherein the pin is electrically isolated from the LED.

20 Claims, 12 Drawing Sheets

Related U.S. Application Data continuation of application No. 13/961,230, filed on Aug. 7, 2013, now Pat. No. 9,335,009, which is a continuation-in-part of application No. 13/766,532, filed on Feb. 13, 2013, now Pat. No. 9,206,970.

(51) Int. Cl.

| | |
|---|---|
| ***F21V 23/06*** | (2006.01) |
| ***F21K 9/27*** | (2016.01) |
| ***F21V 31/00*** | (2006.01) |
| *F21Y 103/10* | (2016.01) |
| *F21Y 115/10* | (2016.01) |

(52) U.S. Cl.

CPC ..... *F21V 27/02* (2013.01); *F21V 31/005* (2013.01); *F21V 31/00* (2013.01); *F21Y 2103/10* (2016.08); *F21Y 2115/10* (2016.08); *Y10T 29/49002* (2015.01)

(58) Field of Classification Search

CPC .. F21K 9/27; Y10T 29/49002; F21Y 2103/10; F21Y 2115/10

USPC ..... 362/221

See application file for complete search history.

(56) References Cited

U.S. PATENT DOCUMENTS

| | | | |
|---|---|---|---|
| 7,510,299 | B2 | 3/2009 | Timmermans et al. |
| 7,815,338 | B2 | 10/2010 | Siemiet et al. |
| 7,946,729 | B2 | 5/2011 | Ivey et al. |
| 9,206,970 | B2 | 12/2015 | Halliwell |
| 9,335,009 | B2 | 5/2016 | Halliwell |
| 10,047,939 | B2 | 8/2018 | Halliwell |
| 2006/0126338 | A1* | 6/2006 | Mighetto ..... F21V 19/003 362/294 |
| 2009/0273917 | A1 | 11/2009 | Bartelink |
| 2010/0103673 | A1 | 4/2010 | Ivey et al. |
| 2010/0270925 | A1 | 10/2010 | Withers |
| 2012/0019166 | A1 | 1/2012 | Terasaka et al. |
| 2012/0243217 | A1 | 9/2012 | Szprengiel et al. |
| 2012/0320572 | A1 | 12/2012 | Fischer et al. |
| 2014/0226320 | A1 | 8/2014 | Halliwell |
| 2014/0226321 | A1 | 8/2014 | Halliwell |

OTHER PUBLICATIONS

United States Patent and Trademark Office, Notice of Allowance for U.S. Appl. No. 13/766,532, dated Sep. 14, 2015, 9 pages, USA.
United States Patent and Trademark Office, Office Action for U.S. Appl. No. 13/961,230, dated Jan. 29, 2015, 16 pages, USA.
United States Patent and Trademark Office, Office Action for U.S. Appl. No. 13/766,532, dated Feb. 4, 2015, 16 pages, USA.
United States Patent and Trademark Office, Office Action for U.S. Appl. No. 13/766,532, dated Jun. 4, 2015, 14 pages, USA.
United States Patent and Trademark Office, Office Action for U.S. Appl. No. 13/961,230, dated Aug. 13, 2014, 15 pages, USA.
United States Patent and Trademark Office, Office Action for U.S. Appl. No. 13/961,230, dated Jun. 18, 2015, 10 pages, USA.
United States Patent and Trademark Office, Office Action for U.S. Appl. No. 13/961,230, dated Sep. 23, 2015, 10 pages, USA.
United States Patent and Trademark Office, Office Action for U.S. Appl. No. 13/766,532, dated Aug. 13, 2014, 16 pages, USA.
United States Patent and Trademark Office, Office Action for U.S. Appl. No. 15/133,732, dated Nov. 16, 2017, USA.
United States Patent and Trademark Office, Notice of Allowance for U.S. Appl. No. No. 15/133,732, dated May 10, 2018, USA.

* cited by examiner

LINEAR LED LAMP TUBE WITH INTERNAL DRIVER AND ONE OR MORE ELECTRICALLY ISOLATED PINS

CROSS-REFERENCE TO RELATED APPLICATIONS

This application claims priority to and is a continuation of U.S. patent application Ser. No. 15/133,732, filed on Apr. 20, 2016, which application is a continuation of and claims priority to U.S. patent application Ser. No. 13/961,230, filed on Aug. 7, 2013 (now U.S. Pat. No. 9,335,009, granted May 10, 2016), which is a continuation-in-part of U.S. patent application Ser. No. 13/766,532, filed on Feb. 13, 2013 (also now U.S. Pat. No. 9,206,970, granted Dec. 8, 2015); the contents of all of which as are hereby incorporated herein in their entireties by reference.

BACKGROUND

Progress in the field of engineering and manufacturing light emitting diodes (LEDs) has resulted in an increased interest in employing LED lamps in general lighting applications. Particularly, an interest exists in replacing fluorescent lamp tubes with LED lamp tubes. LED lamp tubes offer several advantages over traditional fluorescent lamp tubes. For example, LED lamps have a significantly longer life than fluorescent lamps and do not contain the dangerous chemicals that fluorescent lights depend upon for their fluorescence. Fluorescent and LED lamps, however, have different electrical requirements for the fixtures into which they will be installed.

Fluorescent lamp tubes generally have an end cap located at each end of the fluorescent lamp tube. Electrodes located on the end caps, commonly referred to as "pins," are used to electrically and mechanically connect the fluorescent tube lamp into the fixture. Having electrodes at both ends of the tube allows the electrical power to flow across (i.e., through) the lamp tube, causing the lamp tube to fluoresce. Thus, the fixture into which a fluorescent lamp tube is installed will maintain the first end of the tube as electrically positive and the second end of the tube as electrically negative.

LED lamps, on the other hand, require a low voltage source. Indeed, LEDs generally provided within LED lamps require a direct current (DC) voltage. Thus, LED lamps configured in this manner require driver circuitry which regulates the voltage passed to the LEDs. However, conventionally configured driver circuitry does not require the first end of the tube to be electrically positive and the second end to be electrically negative. As a result, a fixture designed for fluorescent lamp tubes may not be readily appropriate for use with LED lamp tubes, without some degree of modification, such as the non-limiting examples of replacing lamp holders, rewiring existing lamp holders, and the like, so as to convert the fixture for use with LED lamps. Notwithstanding the above, certain LED lamps may incorporate alternating current (AC) voltage components; however, modifications remain likewise necessary in that context, as with DC voltage sourced lamp tubes.

Because a huge number of fluorescent light fixtures are currently in use, converting and/or modifying each fixture, whether DC or AC sourced, in one or more of the manners described above would involve a considerable amount of effort and money. Therefore, if various advantages of LED lamp tubes over fluorescent lamp tubes are to be fully realized, a need exists for an LED lamp tube that can be readily installed and used with existing fluorescent light fixtures, without expensive modifications or replacement of the fixtures.

BRIEF SUMMARY

Generally described, various embodiments of the present invention comprise a linear wired LED lamp tube configured to replace a fluorescent lamp tube, such as the non-limiting examples of a T8 or T12 fluorescent lamp tube, or the like. The self-ballasted LED lamp tube of various embodiments comprises driver circuitry disposed within the tube, and pins configured to only mechanically connect to the light fixture. In this manner, the pins, according to various embodiments, are electrically isolated from the electrical components of the lamp tube. Thus, the tombstones of a traditional fluorescent light fixture do not need to be modified to accommodate the LED lamp tube of the present invention. As a result, according to various embodiments, power may be supplied to the LED lamp tube via the non-limiting example of a set of wires protruding directly from the LED lamp tube that are connected directly to a branch wire circuit. In certain embodiments, the connection to the branch wire circuit may be made using a quick connect connector and/or with any approved wiring connection device, as may be desirable for particular applications.

In various embodiments, an LED lamp tube for placement in a fluorescent light fixture is provided wherein the LED lamp tube comprises: a substantially elongate member comprising a first end surface, a second end surface, and an intermediate surface substantially between said first and second end surfaces, said surfaces collectively defining an interior cavity of said elongate member; at least one light emitting diode (LED) positioned within said interior cavity and adjacent said intermediate surface; and a passage formed through at least a portion of said substantially elongate member, said passage being configured to receive there-through at least a first end of a set of electrical connecting wires, wherein said first end of said set of electrical connecting wires comprises at least one of a two- or three-prong polarized plug.

In various embodiments, an LED lamp tube for placement in a fluorescent light fixture is provided wherein the LED lamp tube comprises: a substantially elongate member comprising a first end surface, a second end surface, and an intermediate surface substantially between said first and second end surfaces, said surfaces collectively defining an interior cavity of said elongate member; at least one light emitting diode (LED) positioned within said interior cavity and adjacent at least a portion of said intermediate surface; at least one driver circuit positioned within said interior cavity, said driver circuit comprising a set of electrical connecting wires and being configured to provide a controllable electrical current to said at least one LED; and a passage formed through at least a portion of said substantially elongate member, said passage being configured to receive there-through at least a portion of said set of electrical connecting wires, wherein said at least a portion of said set of electrical connecting wires comprises at least one of a two- or a three-prong polarized plug.

In various embodiments, an LED lamp tube for placement in a fluorescent light fixture is provided, wherein the LED lamp tube comprises: a substantially elongate member comprising a first end surface, a second end surface, and an intermediate surface substantially between said first and second end surfaces, said surfaces collectively defining an interior cavity of said elongate member; at least one light emitting diode (LED) positioned within said interior cavity and adjacent said intermediate surface; at least one pin secured on each of said first and second end surfaces, wherein at least a portion of said pin is disposed external said interior cavity and configured to mount said LED lamp tube to said fluorescent light fixture such that said at least one pin is electrically isolated from said fluorescent light fixture; and a passage formed through at least a portion of said substantially elongate member, said passage being configured to receive there-through at least a first end of a set of electrical connecting wires, wherein said first end of said set of electrical connecting wires comprises at least one of a two- or a three-prong polarized plug.

In various embodiments, a method of installing at least one LED lamp tube in a fluorescent light fixture is provided, wherein the method comprises the steps of: (A) providing at least one LED lamp tube comprising: (1) a substantially elongate member comprising a first end surface, a second end surface, and an intermediate surface substantially between said first and second end surfaces, said surfaces collectively defining an interior cavity of said elongate member; (2) at least one light emitting diode (LED) positioned within said interior cavity and adjacent at least a portion of said intermediate surface; (3) at least one driver circuit positioned within said interior cavity, said driver circuit comprising a set of electrical connecting wires and being configured to provide a controllable electrical current to said at least one LED; (4) a passage formed through at least a portion of said substantially elongate member, said passage being configured to receive there-through a first end of said set of electrical connecting wires, wherein said first end of said set of electrical connecting wires comprises at least one of a two- or three-prong polarized plug; and (5) at least one pin secured on each of said first and second end surfaces, wherein at least a portion of said pin is disposed external said interior cavity and electrically isolated from at least said at least one driver circuit; (B) mounting said at least one LED lamp tube into said fluorescent light fixture via said at least one pin such that said pin is further electrically isolated from said fluorescent light fixture; and (C) electrically connecting said at least one internally positioned driver circuit to said fluorescent light fixture via said set of electrical connecting wires extending substantially through said passage by inserting the two- or three-prong polarized plug into a line voltage plug-in receptacle.

In various embodiments, an LED lamp tube for placement in a fluorescent light fixture is provided wherein the LED lamp tube comprises: a substantially elongate member comprising a first end surface, a second end surface, and an intermediate surface substantially between the first and second end surfaces, the surfaces collectively defining an interior cavity of the elongate member; at least one light emitting diode (LED) positioned within the interior cavity and adjacent the intermediate surface; and a passage formed through at least a portion of the substantially elongate member, the passage being configured to receive there-through at least a first end of a set of electrical connecting wires.

In various embodiments, an LED lamp tube for placement in a fluorescent light fixture is provided wherein the LED lamp tube comprises: a substantially elongate member comprising a first end surface, a second end surface, and an intermediate surface substantially between the first and second end surfaces, the surfaces collectively defining an interior cavity of the elongate member; at least one light emitting diode (LED) positioned within the interior cavity and adjacent at least a portion of the intermediate surface; at least one driver circuit positioned within the interior cavity, the driver circuit comprising a set of electrical connecting wires and being configured to provide a controllable electrical current to the at least one LED; and a passage formed through at least a portion of the substantially elongate member, the passage being configured to receive there-through at least a portion of the set of electrical connecting wires.

In various embodiments, an LED lamp tube for placement in a fluorescent light fixture is provided wherein the LED lamp tube comprises: a substantially elongate member comprising a first end surface, a second end surface, and an intermediate surface substantially between the first and second end surfaces, the surfaces collectively defining an interior cavity of the elongate member; at least one light emitting diode (LED) positioned within the interior cavity and adjacent the intermediate surface; and at least one pin secured on each of the first and second end surfaces, wherein at least a portion of the pin is disposed external the interior cavity and configured to mount the LED lamp tube to the fluorescent light fixture such that the at least one pin is electrically isolated from the fluorescent light fixture In various embodiments, an LED lamp tube for placement in a fluorescent light fixture is provided wherein the LED lamp tube comprises: a substantially elongate member comprising a first end surface, a second end surface, and an intermediate surface substantially between the first and second end surfaces, the surfaces collectively defining an interior cavity of the elongate member; at least one LED positioned within the interior cavity and adjacent at least a portion of the intermediate surface; and at least one driver circuit positioned within the interior cavity, the driver circuit comprising a set of electrical connecting wires and being configured to provide a controllable electrical current to at least one LED.

In various embodiments, an LED lamp tube for placement in a fluorescent light fixture is provided wherein the LED lamp tube comprises: a substantially elongate member comprising a first end surface, a second end surface, and an intermediate surface substantially between the first and second end surfaces, the surfaces collectively defining an interior cavity of the elongate member; at least one LED positioned within the interior cavity and adjacent the intermediate surface; at least one pin secured on each of the first and second end surfaces, wherein at least a portion of the pin is disposed external the interior cavity and configured to mount the LED lamp tube to the fluorescent light fixture such that the at least one pin is electrically isolated from the fluorescent light fixture.

In various embodiments, an LED lamp tube for placement in a fluorescent light fixture is provided wherein the LED lamp tube comprises: a substantially elongate member comprising a first end surface, a second end surface, and an intermediate surface substantially between the first and second end surfaces, the surfaces collectively defining an interior cavity of the elongate member; at least one LED positioned within the interior cavity and adjacent the intermediate surface; a passage formed through at least a portion of the substantially elongate member, the passage configured to receive there-through the set of electrical connecting wires; and a connector located external relative to the substantially elongate member, wherein a first end of the set of electrical connecting wires is secured in an appropriate position in the connector.

In various embodiments, a method of installing at least one LED lamp tube in a fluorescent light fixture is provided. In various such embodiments, the method comprises the steps of: (A) providing at least one LED lamp tube comprising: (1) a substantially elongate member comprising a first end surface, a second end surface, and an intermediate surface substantially between the first and second end surfaces, the surfaces collectively defining an interior cavity of the elongate member; (2) at least one light emitting diode (LED) positioned within the interior cavity and adjacent at least a portion of the intermediate surface; (3) at least one driver circuit positioned within the interior cavity, the driver circuit comprising a set of electrical connecting wires and being configured to provide a controllable electrical current to the at least one LED; (4) a passage formed through at least a portion of the substantially elongate member, the passage being configured to receive there-through a first end of the set of electrical connecting wires; and (5) at least one pin secured on each of the first and second end surfaces, wherein at least a portion of the pin is disposed external the interior cavity and electrically isolated from at least the at least one driver circuit; (B) mounting the at least one LED lamp tube into the fluorescent light fixture via the at least one pin such that the pin is further electrically isolated from the fluorescent light fixture; (C) electrically connecting the at least one internally positioned driver circuit to the fluorescent light fixture via the set of electrical connecting wires extending substantially through the passage.

BRIEF DESCRIPTION OF THE SEVERAL VIEWS OF THE DRAWING(S)

Having thus described various embodiments of the invention in general terms, reference will now be made to the accompanying drawings, which are not necessarily drawn to scale, and wherein:

DETAILED DESCRIPTION

Various embodiments of the present invention now will be described more fully hereinafter with reference to the accompanying drawings, in which some, but not all embodiments are shown. Indeed, the invention may be embodied in many different forms and should not be construed as limited to the various embodiments set forth herein; rather, the embodiments described herein are provided so that this disclosure will satisfy applicable legal requirements. Like numbers refer to like elements throughout.

A. Structural Features of Various Embodiments

Figure 1:
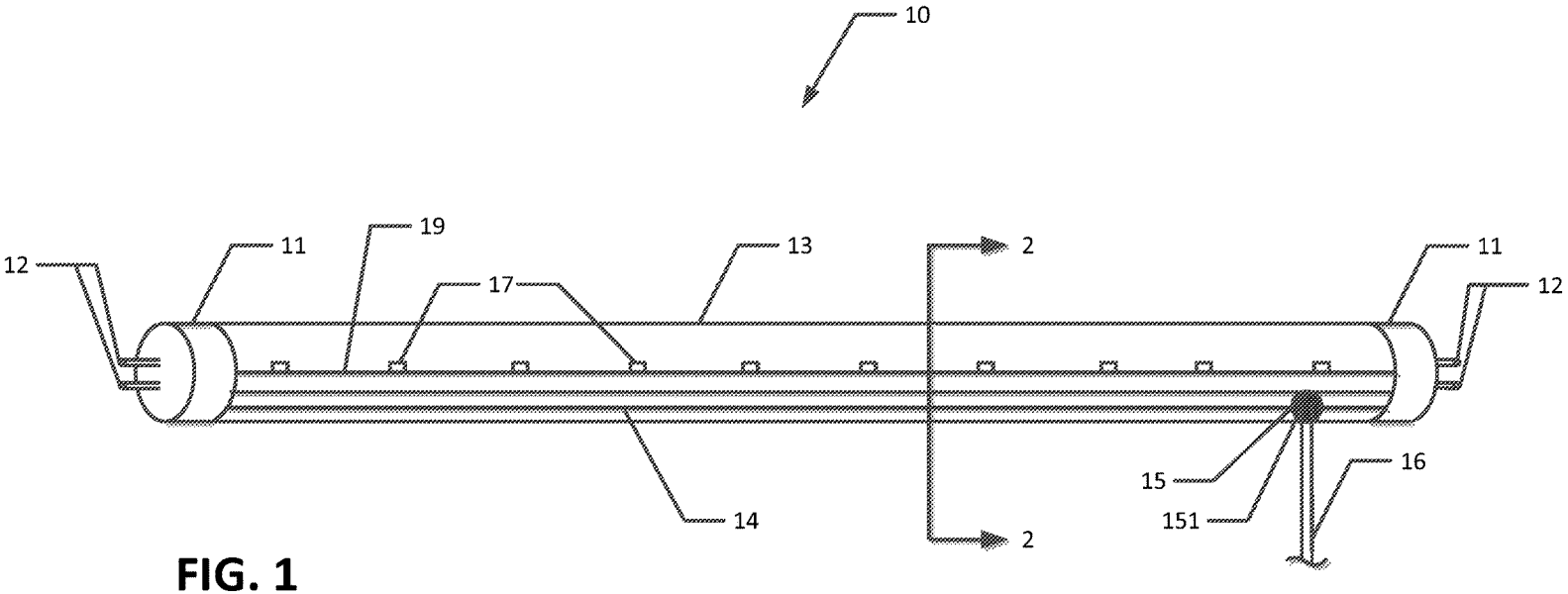
FIG. 1 is a side view according to various embodiments of the LED lamp tube.
Figure 6:
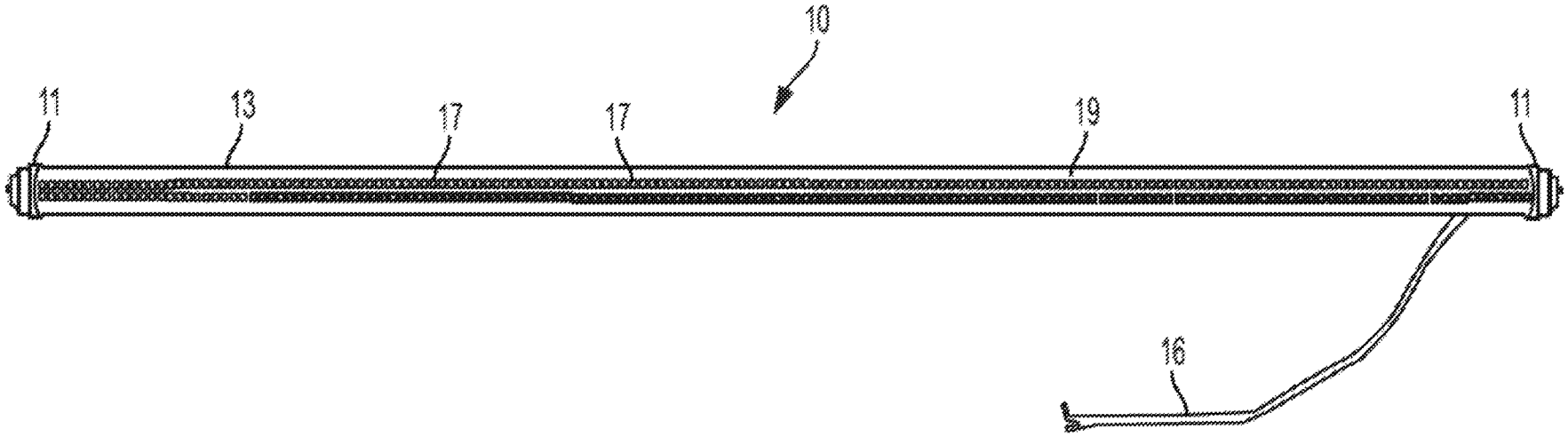
FIG. 6 is a top view of an LED lamp tube according to various embodiments of the present invention.

FIGS. 1 and 6 show side-views of various embodiments of the LED lamp tube 10. FIGS. 7-10 show other perspectives views of various embodiments of the LED lamp tube 10. With reference specifically to FIG. 1, in various embodiments, the body of the lamp tube 10 comprises a lens 13, a back cover 14, and at least one end cap 11, wherein one end cap may cap off each end of the body of the lamp tube 10. In these embodiments, the lens 13, back cover 14, and end caps 11 enclose the electrical circuitry and the LEDs 17 substantially within an internally defined cavity, thus protecting them from moisture, debris, and tampering.

In various embodiments, the LED lamp tube 10 may referred to interchangeably as comprising a substantially elongate member that may itself comprise at least an intermediate surface located substantially between a first end surface and a second end surface. In such embodiments, the intermediate surface may comprise the lens 13 and the back cover 14, as will be described in further detail below. The first and second end surfaces may likewise comprise the at least one end cap 11 in certain embodiments, while in other embodiments the first and second end surfaces may comprise the end caps 11 and one or more pins, as will be described in further detail later herein. In any of these and still other embodiments, it should be understood that the substantially elongate member of the LED lamp tube 10 is configured so as to enclose the electrical circuitry and the LEDs 17 substantially within an internally defined cavity, thus protecting them from moisture, debris, and tampering.

1. Lens 13

Remaining with FIG. 1, it should be understood that the lens 13 may be configured such that at least some portion of the light emitted by the LEDs 17 can pass through the lens 13. For example, in various embodiments, the lens 13 may be configured such that at least 10% of the light emitted by the LEDs 17 can pass through the lens 13. In some embodiments, the lens 13 may be configured such that a significant fraction of the light emitted by the LEDs 17 can pass through the lens 13. For example, in certain various embodiments, the lens 13 may be configured to permit 10-30%, 30-50%, or 60-80% of the light emitted by the LEDs 17 to pass through the lens 13. In some embodiments, the lens 13 may be configured to permit at least 50% of the light emitted by the LEDs 17 to pass through the lens 13. In certain embodiments, the lens 13 may be configured such that substantially all of the light emitted by the LEDs 17 may pass through the lens 13. For example, in some embodiments, the lens 13 may be configured to permit more than 80%, or in certain embodiments, more than 90%, of the light emitted by the LEDs 17 to pass through lens 13.

In various embodiments, the lens 13 may be made from a polymerized material, as commonly known and understood in the art. In certain embodiments, the lens 13 may be made of plastic. In some embodiments, the lens 13 may be made of an opaque material; however, in other embodiments, the lens 13 may be made of any of a variety of translucent or semi-translucent materials, as may be commonly known and used in the art. Still further, according to other embodiments, the lens 13 may be clear or frosted. In at least one embodiment, the lens 13 may be made of Smart Glass, or some other material that can transition from clear to frosted and/or vice versa. In yet other embodiments, the lens 13 may be tinted with various colors. For example, in at least one embodiment, the lens 13 may be tinted blue to give the light emitted by the lamp a blue glow. Indeed, it should be understood that the lens 13 may be made from any of a variety of materials, as may be commonly known and used and readily available in the art, provided such possess the light transmission characteristics that are desirable for particular applications.

In various embodiments, the translucent or semi-translucent material may permit passage of at least some portion of the light emitted by the LEDs 17 through the lens 13. In certain embodiments, the translucent or semi-translucent material may allow passage of at least 10% of the light emitted by the LEDs 17 to pass through the lens 13. In at least one embodiment, the translucent or semi-translucent material may permit passage of 10-30% of the light emitted by the LEDs 17 to pass through the lens 13. In other certain embodiments, the translucent or semi-translucent material may be configured to permit passage of 30-50% of the light emitted by the LEDs 17 to pass through the lens 13. In still other embodiments the translucent or semi-translucent material may permit passage of more than 50%, or, in certain various embodiments, more than 80%, of the light emitted by the LEDs 17 to pass through lens 13. Alternatively, the translucent or semi-translucent material may permit passage of 60-80% of the light emitted by LEDs 17 to pass through the lens 13. Indeed, it should be understood that according to various embodiments, the lens 13 may be configured to permit at least some desired portion of the light emitted by the LEDs 17 to pass through the lens 13, however as may be beneficial for particular applications.

In various embodiments, the cross-section of the lens 13 may be generally semi-circular. In certain embodiments, the cross-section of the lens 13 may be generally a portion of an ellipse. In other embodiments, the cross-section of the lens 13 may comprise a plurality of flat or curved edges that combine to comprise a generally semi-circular cross-section or a cross-section which is generally a portion of an ellipse. In still other embodiments, the cross-section of the lens 13 may not be generally circular or elliptical and may be generally rectangular or alternatively shaped.

It should be further understood that various embodiments, the LED lamp tube 10 may comprise a substantially elongate member that may comprise at least an intermediate surface located substantially between a first end surface and a second end surface. In such embodiments, at least a portion of the intermediate surface may comprise the lens 13, as previously described herein. In these and still other embodiments, the intermediate surface may further comprise additional components other than the lens 13, such as, for example, the back cover 14, as will be described in further detail below.

2. Back Cover 14

As shown in FIG. 1, in various embodiments, the LED lamp tube 10 further comprises a back cover 14. In various such embodiments, the cross-section of the back cover 14 may be generally semi-circular. In certain embodiments, the cross-section of the back cover 14 may be generally a portion of an ellipse. In other embodiments, the cross-section of the back cover 14 may comprise a plurality of flat or curved edges that combine to comprise a generally semi-circular cross-section or a cross-section which is generally a portion of an ellipse. In still other embodiments, the cross-section of the back cover 14 may not be generally circular or elliptical and may be generally rectangular or alternatively shaped.

In various embodiments, the back cover 14 and the lens 13 may be configured to provide, when combined, a circular cross-section or an elliptical cross-section. In certain embodiments, the when the back cover 14 and the lens 13 are combined, they may provide a cross-section wherein at least part of the cross-section comprises a plurality of flat or curved edges that combine to comprise a generally circular or elliptical cross-section. In at least one embodiment, the back cover 14 may comprise 30% of the circumference of the LED lamp tube 10. In other embodiments, the back cover 14 may comprise 40% of the circumference of the LED lamp tube 10. In still other embodiments, the back cover 14 may comprise at least 50% of the circumference of the LED lamp tube 10. For example, in at least one embodiment, the back cover 14 may comprise 50% of the circumference of the LED lamp tube 10 and in at least one other embodiment the back cover 14 may comprise 60% of the circumference of the LED lamp tube 10. All of the above notwithstanding, generally speaking, according to various embodiments, the back cover 14 and the lens 13 are configured such that, when combined, they comprise approximately 100% of the circumference of the tube 10.

The diameter of the circumference comprising the back cover 14 and the lens 13 may, in various embodiments, be approximately one inch. In other embodiments, the diameter may be in a range of approximately one-half an inch to approximately one inch. In at least one exemplary embodiment, the diameter may be 0.625 inches. In other embodiments, the diameter may be substantially greater than one inch, as may be desirable for particular applications. In still other embodiments, the diameter may be approximately 1.5 inches.

Remaining with FIG. 1, in various embodiments, both the lens 13 and the back cover 14 may be substantially elongated so as to form a longitudinal axis of the tube 10. For example, in some embodiments, the lens 13 and the back cover 14 may each be approximately 1, 2, or 3 feet long. In other embodiments the lens 13 and back cover 14 may each be approximately 4 feet long. In other embodiments, the lens 13 and back cover 14 may each be approximately 8 feet long.

As will be appreciated, the lens 13 and back cover 14 may have any of a variety of other lengths in keeping with other various embodiments of the present invention. That being said, it should be understood that in any of these and still other embodiments, the lens 13 and back cover 14 will generally typically have approximately the same linear length, as may be desirable for particular applications. Of course, various modifications may exist, whereby the relative lengths of the lens 13 and the back cover 14 may not necessarily be substantially the same, as may be desirable for still other applications.

In various embodiments, the lens 13 and the back cover 14 may be positioned and retained relative to one another so as to provide a substantially fixed and rigid "tube" structure. In certain embodiments, the lens 13 and the back cover 14 may be configured to snap together. In other embodiments, the lens 13 and the back cover 14 may be glued together with an appropriate adhesive. In still other embodiments, the lens 13 and the back cover 14 may be held in place by the end caps 11. It should be appreciated, however, that in any of these and still other embodiments, the lens 13 and back cover 14 may be held in place by any of a variety of alternative mechanisms and/or methods, as may be generally known and used in the art.

The back cover 14 may be made of plastic in some embodiments, but may be made of aluminum or other materials in other embodiments. In various embodiments, the back cover 14 may be configured to dissipate waste heat emitted by the LEDs 17 and or the driver circuitry 18. In various embodiments, the back cover 14 may comprise a series of ridges along at least a part of the circumference of back cover 14. In some such embodiments, the ridges may be less than 1 mm in height. In other such embodiments, the ridges may be at least 1 mm in height. In certain embodiments, the ridges may be less than 2 mm in height. In still other embodiments, the ridges may be no more than 5 mm in height. In some embodiments, the ridges may be configured to permit heat to dissipate out from the LED lamp tube 10. In certain embodiments, the ridges may be configured to optimize the amount of heat which can be dissipated by the back cover 14.

It should be understood that various embodiments, the LED lamp tube 10 may comprise a substantially elongate member that may comprise at least an intermediate surface located substantially between a first end surface and a second end surface. In such embodiments, the intermediate surface may comprise the lens 13 and the back cover 14, as previously described herein. In other embodiments, the intermediate surface may comprise additional components other than the lens 13 and the back cover 14. In at least one embodiment, approximately one half of the intermediate surface comprises the lens 13, while the remaining approximate half comprises the back cover 14, as has been described elsewhere herein.

3. End Cap 11

As noted above and illustrated in FIG. 1, in various embodiments, the LED lamp tube 10 may further comprise at least one end cap 11 disposed on an end of the body of the LED lamp tube 10. In various embodiments, the LED lamp tube 10 may further comprise an end cap 11 disposed on each end the body of the LED lamp tube 10. In various embodiments, the end caps 11 are generally circular in cross-section. In other embodiments, the end caps 11 may be generally elliptical in cross-section. In some embodiments, the cross-section of the end caps 11 may at least in part comprise a plurality of straight or curved edges which, when combined, comprise at least part of a generally circular or generally elliptical cross-section. In certain other embodiments, the cross-section of the end caps 11 may not be generally circular or elliptical and may be generally rectangular or alternatively shaped.

In various embodiments, some portion of the length of the lens 13 and the back cover 14 is inserted into each end cap 11. In some embodiments, approximately 0.25 inches of the length of the lens 13 and the back cover 14 may be inserted into each end cap 11. In other embodiments, 0.5-0.25 inches of the length of the lens 13 and the back cover 14 may be inserted into each end cap 11. In still other embodiments, less than 0.25 inches of the length of the lens 13 and the back cover 14 may be inserted into each end cap 11. In at least one embodiment, more than 0.5 inches of the length of the lens 13 and back cover 14 may be inserted into each end cap 11.

Figure 7:
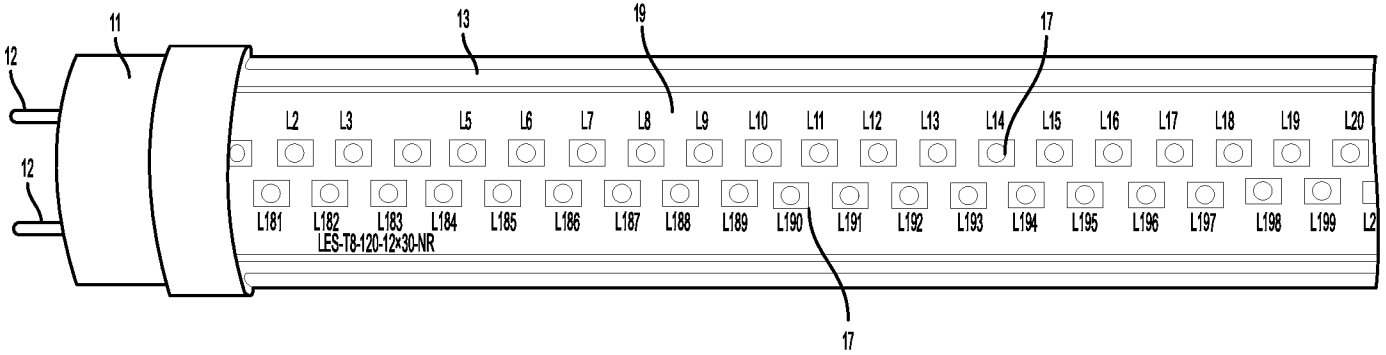
FIG. 7 is a close up top view of one end of an LED lamp tube according to various embodiments of the present invention.
Figure 8:
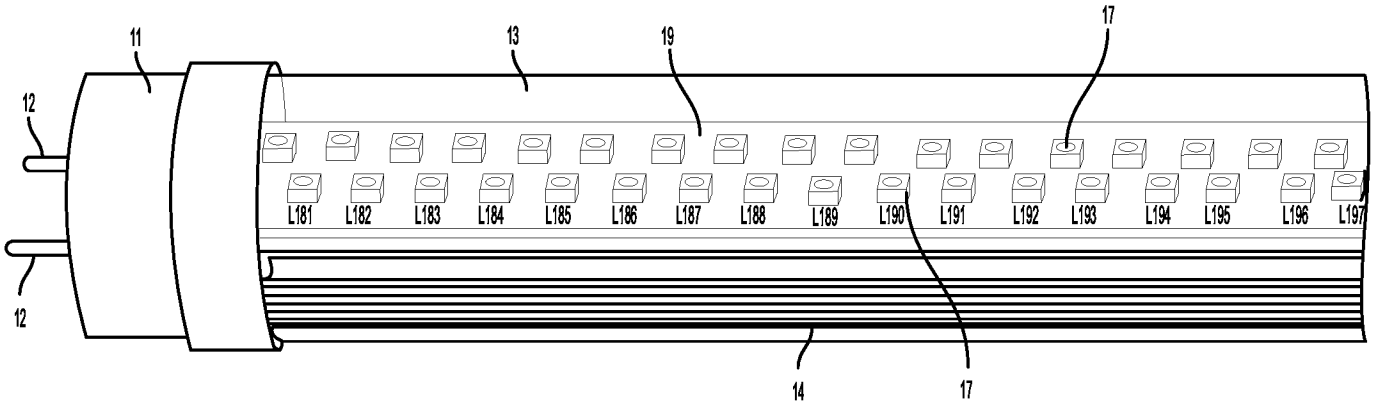
FIG. 8 is a perspective view of one end of an LED lamp tube according to various embodiments of the present invention.
Figure 9:
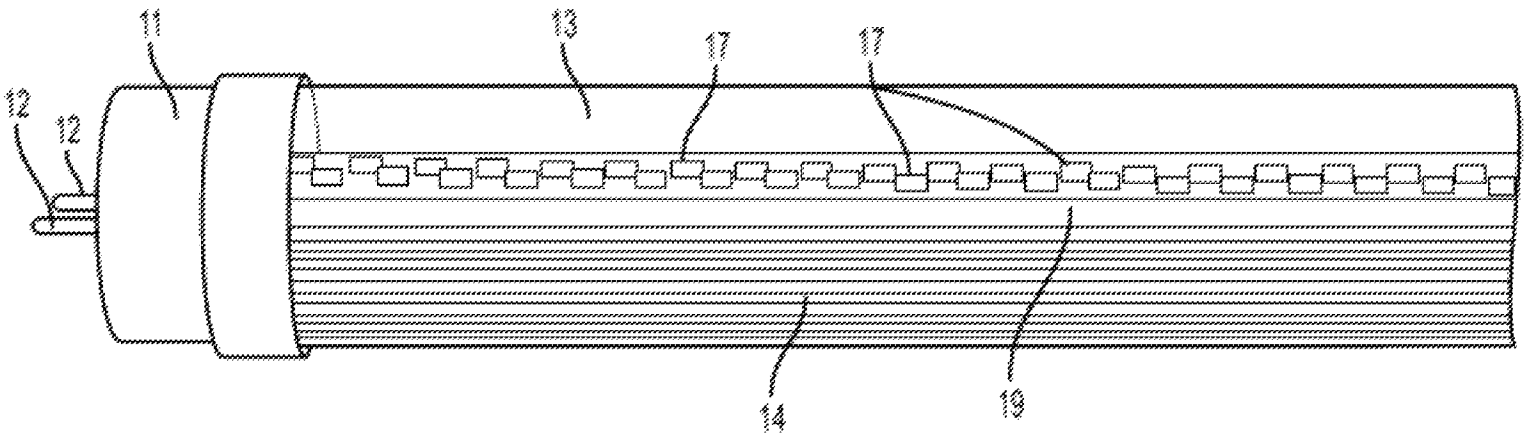
FIG. 9 is a side view of one end of an LED lamp tube according to various embodiments of the present invention.
Figure 10:
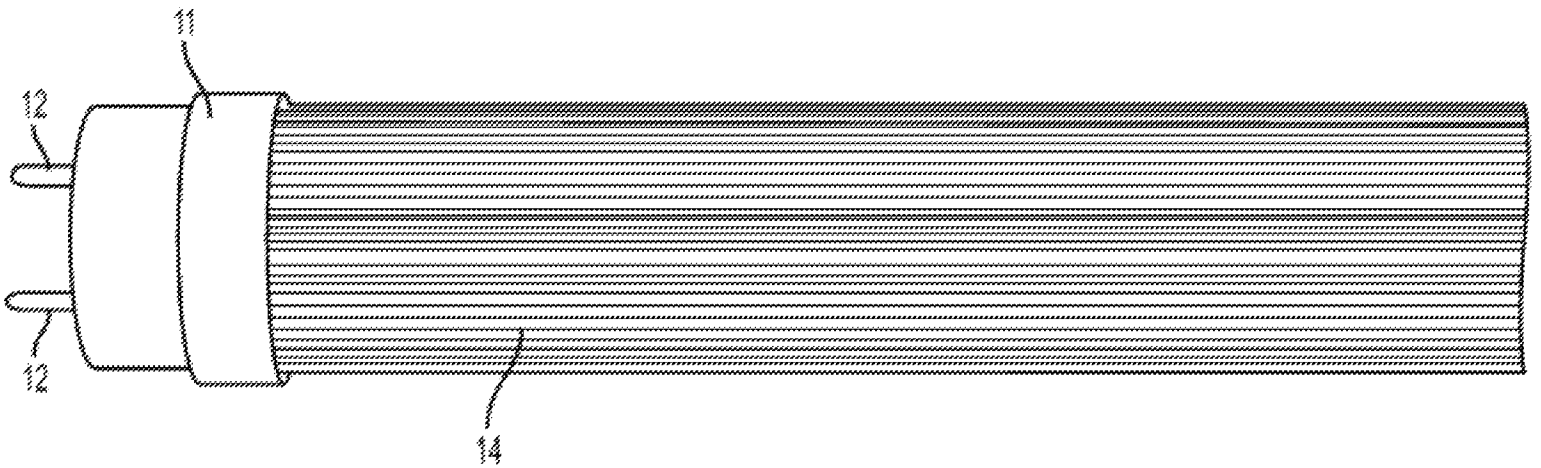
FIG. 10 is a bottom view of one end of an LED lamp tube, according to various embodiments of the present invention.

In various embodiments, the diameter of an end cap 11 may be configured such that the lens 13 and the back cover 14 may be secured within the end cap 11. Thus, in various embodiments, the inside diameter of the end cap may be substantially the same as the outside diameter of the lens 13 and the back cover 14. As shown in FIG. 7, in some embodiments, the end cap 11 may have a step profile wherein the portion of the end cap 11 into which a portion of the lens 13 and a portion of the back cover 14 are inserted is different from the portion of the end cap 11 that does not contain a portion of the lens 13 or back cover 14. For example, the portion of the end cap 11 into which a portion of the lens 13 and a portion of the back cover 14 are inserted may have a larger diameter than the portion of the end cap 11 that does not contain a portion of the lens 13 or back cover 14. In certain embodiments, the portion of the end cap 11 that does not contain a portion of the lens 13 or back cover 14 may have an outer diameter that is substantially the same as the outer diameter of the lens 13 and the back cover 14.

The end caps 11 may be plastic in some embodiments, or other materials in other embodiments. In some embodiments, the end caps 11 may be secured to the LED lamp tube 10 via screws. In certain embodiments, the end caps 11 are secured to the reflective back plate 19 via screws or some other securing mechanism. In other embodiments, the end caps 11 maybe secured to the LED lamp tube 10 by other mechanisms.

Figure 18:
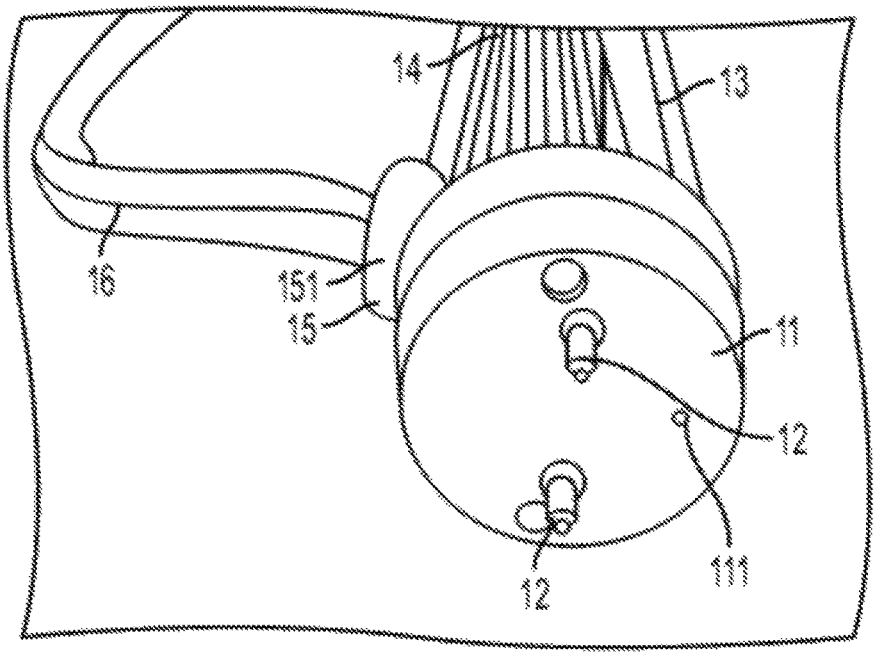
FIG. 18 is an end view of one end of an LED lamp tube, according to various embodiments of the present invention

As illustrated in FIG. 18, in some embodiments, the at least one end cap 11 may comprise a small hole 111 on the end of the end cap 11. In some such embodiments, the hole 111 is less than 1 mm in diameter. In other embodiments the hole 111 is 1-2 mm in diameter. In still other embodiments, the hole 111 is 2-3 mm in diameter. In various embodiments, the hole 111 acts to allow the pressure within the tube to maintain a pressure substantially similar to the ambient air pressure. Other embodiments may not include a hole in the at least one end cap 11. In some such embodiments, the pressure within the tube may be regulated by other mechanisms.

Figure 17:
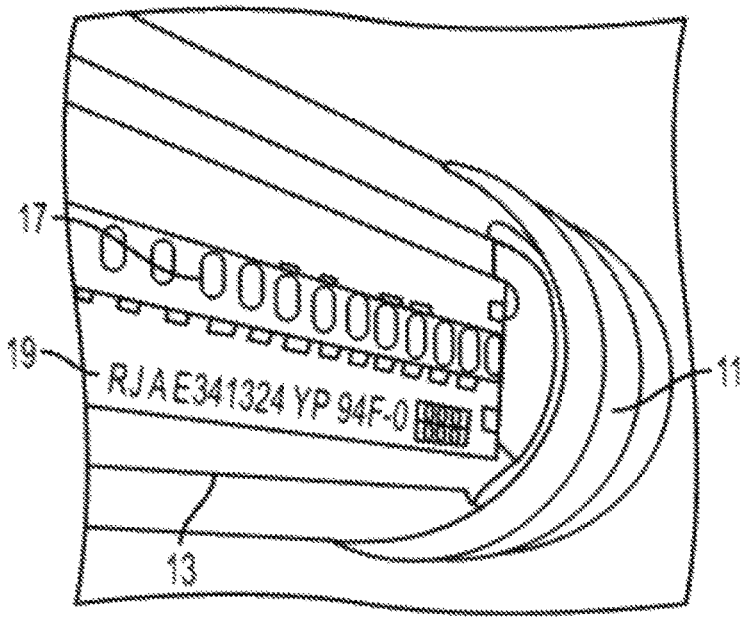
FIG. 17 is a perspective top view of a second end of an LED lamp tube, according to various embodiments of the present invention.

Returning to FIG. 1, the pins 12 are located on the at least one end cap 11. The pins 12 are used to mechanically connect the lamp tube to the lighting fixture, in various embodiments. The pins 12 are electrically isolated from the circuitry within the LED lamp tube 10. FIG. 17 illustrates that the pins 12 secured to end cap 11, are not in electrical contact with the circuitry of the LED lamp tube 10.

In some embodiments, such as the illustrated embodiment of FIG. 1, the pins 12 may be two cylindrical structures. In other embodiments, the pins 12 may be one structure. Other possible configurations of the pins 12 may be apparent to those skilled in the art to mechanically connect the LED lamp tube 10 to the lighting fixture. In various embodiments, the pins 12 may be configured for use in a T5, T8, T12, or similar lighting fixture.

In various embodiments, the pins 12 may be made of plastic or some other non-conductive material. In other embodiments, the pins 12 may be made of metal. The pins 12 may be made out of other materials in other embodiments.

Figure 11:
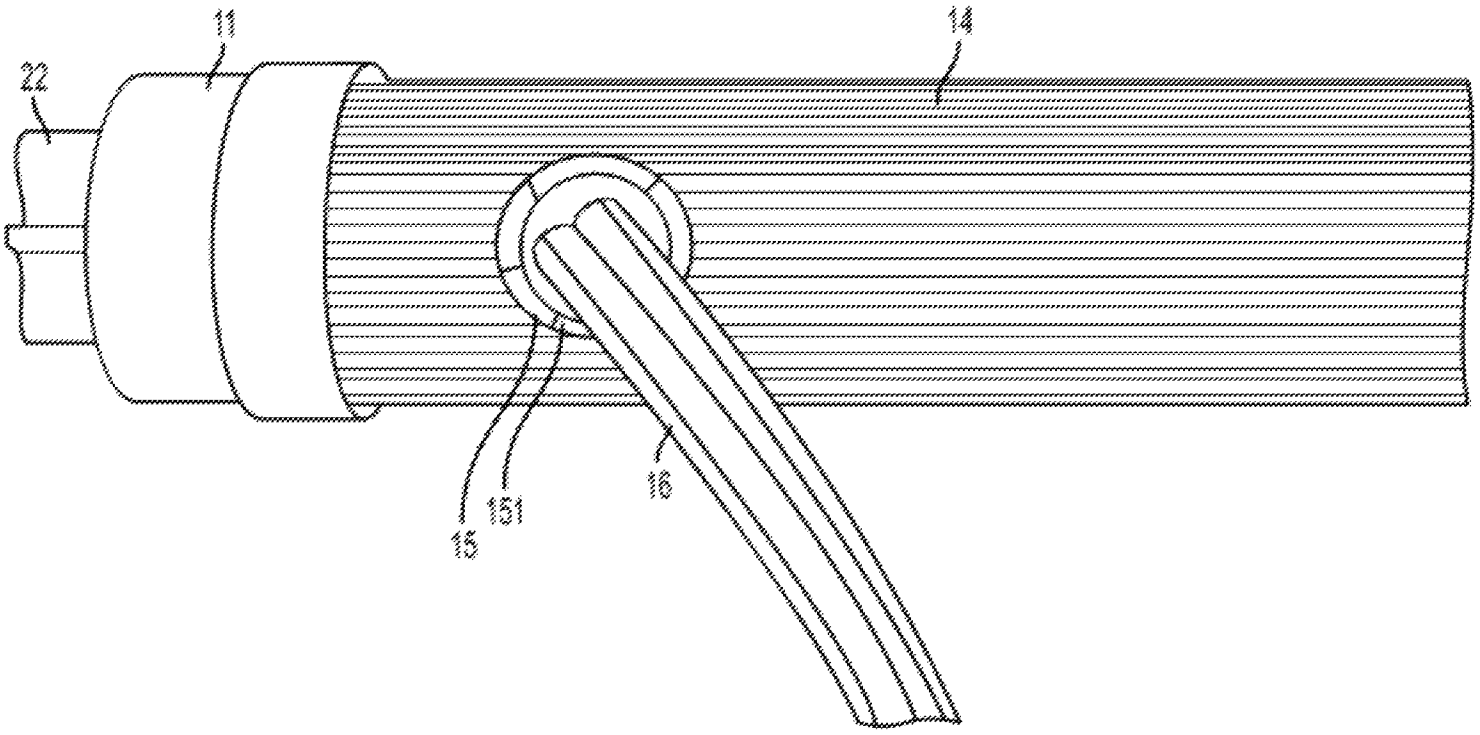
FIG. 11 is a back view of one end of an LED lamp tube, according to various embodiments of the present invention.
Figure 12:
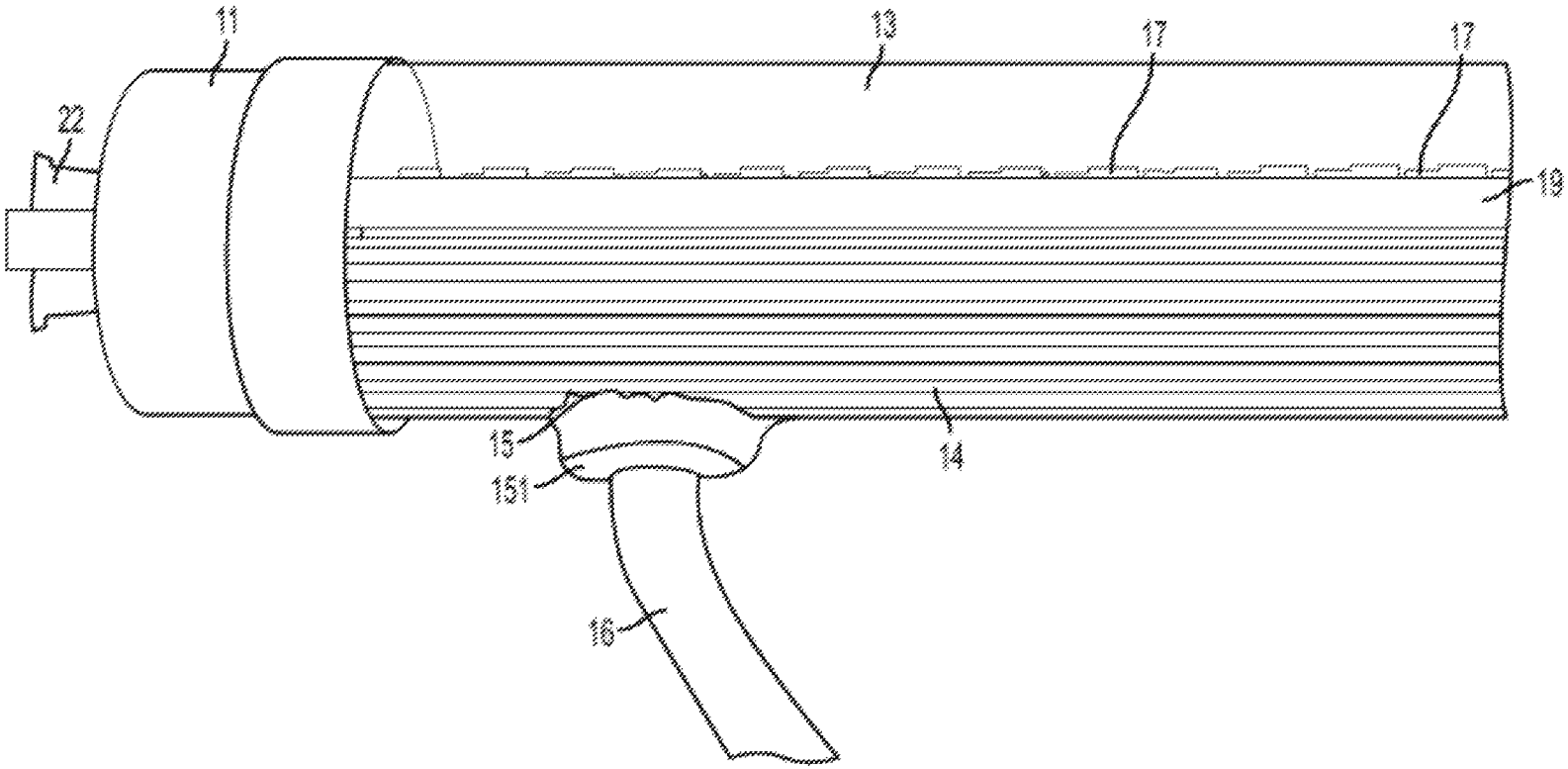
FIG. 12 is a side view of one end of an LED lamp tube, according to various embodiments of the present invention.

During shipment or storage, the pin cover 22 may be used to protect the pins 12, as illustrated in FIGS. 11-12. As the pins 12 are used to mechanically secure the LED lamp tube 10 into a lighting fixture, and not used to electrically connect the LED lamp tube 10 to the lighting fixture, in various embodiments, pin cover 22 may be left on the pins 12 when LED lamp tube 10 is installed into a lighting fixture, if the lighting fixture will accommodate pin cover 22.

It should be understood that various embodiments, the LED lamp tube 10 may comprise a substantially elongate member that may comprise a first end surface and a second end surface. In such embodiments, the first and second end surfaces may comprise at least the end caps 11, as previously described herein. In other embodiments, the first and second end surfaces may be something other than or in addition to the end caps 11. Indeed, in certain embodiments, the first and second end surfaces may comprise at least some combination of the end caps the back cover 14, as previously described herein. However, in other embodiments, the second end surface may be something other than a back cover 14.

4. Passage 15 and Snap-In 151

Again returning to FIG. 1, the LED lamp tube 10 may also comprise a passage 15, in various embodiments. In some embodiments, the passage 15 may allow electrical connecting wires 16 to pass through the body of the LED lamp tube 10. In some embodiments, the passage 15 may be generally circular or elliptical. In other embodiments, the passage 15 may be generally rectangular or alternatively configured.

Figure 13A:
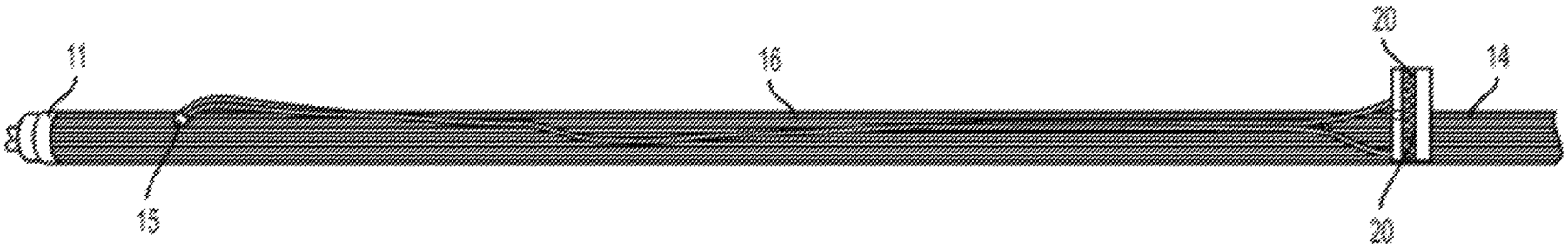
FIG. 13A is a perspective view of an LED lamp tube with electrical connecting wires inserted into a WAGO 773 style quick connect connector, according to various embodiments of the present invention.

As shown in FIG. 13A, in various embodiments, the passage 15 may be disposed within the back cover 14 of the LED lamp tube 10. In some such embodiments, the passage 15 may be centered on the circumference of the back cover 14. In other embodiments, the passage 15 may be offset from the center of the circumference of the back cover 14. In some embodiments, the passage 15 may be disposed substantially near one end of the LED lamp tube 10. For example, in at least one embodiment, the passage 15 maybe located within 6 inches of one end of a four foot long LED lamp tube 10. In some embodiments, the passage 15 is disposed within 10% of the length of the LED tube lamp 10 from an end of an LED lamp tube 10. In some such embodiments, the passage 15 may be located within 5% of the length of the LED lamp tube 10 from an end of the LED lamp tube 10. In certain embodiments, the passage 15 is located substantially next to an end cap 11 disposed on an end of an LED lamp tube 10. In other embodiments, however, it should be understood that the passage may be a knockout or a hole drilled through a tombstone 5 or other component of the lighting fixture, as may be desirable for particular applications and as will be described in further detail below.

In various embodiments, the passage 15 acts to at least partially seal the tube body around the electrical connecting wires 16 such that moisture and/or debris may not be able to enter the body of the tube. In some such embodiments, an insert member or snap-in 151 may be disposed within the passage 15, as shown in FIGS. 11, 12, 13A, and 13B. In some embodiments, the snap-in 151 may be secured into the passage 15 with an appropriate attachment mechanism, such as the non-limiting examples of adhesives, Velcro, glue, or the like. In other embodiments, the snap-in may be formed from a rubber material and secured in passage 15 through other appropriate mechanisms, such as a press fit or other mechanisms. In some embodiments, snap-in 151 is secured into the passage 15 such that the snap-in 151 is selectively removable. In other embodiments, the snap-in 151 may be permanently secured into passage 15. In other embodiments, mechanisms other than a snap-in may be utilized to at least partially seal the tube body around the electrical connecting wires 16 that pass through the passage 15.

As shown in FIG. 11, in various embodiments, the snap-in 151 may comprise flanges on the inside and or outside of the LED lamp tube 10 that act to at least partially seal the LED lamp tube 10 around the electrical connecting wires 16. In some embodiments, the snap-in 151 may comprise a moveable sealing member that may be adjusted to at least partially seal the LED lamp tube 10 around the electrical connecting wires 16 and then locked into place. In other embodiments, the snap-in 151 may be configured to seal the LED lamp tube 10 around the electrical connecting wires 16 by another mechanism. In certain embodiments, the snap-in 151 substantially seals the LED lamp tube 10 around the electrical connecting wires 16. In various embodiments, the snap-in 151 may be made of rubber. In other embodiments, other materials may be used to make the snap-in 151.

In various embodiments, the snap-in 151 is generally circular or elliptical. In other embodiments, the snap-in 151 may be generally rectangular or alternatively shaped. In various embodiments, the snap-in 151 is approximately a 0.5 inches in diameter. In other embodiments the snap-in 151 may be 0.25 to 0.5 inches in diameter. In certain embodiments, the snap-in 151 may be more than 0.5 inches or less than 0.25 inches in diameter.

In some embodiments, the electrical connecting wires 16 may pass through a hole disposed in the central region of snap-in 151. In other embodiments, the electrical connecting wires 16 may pass through a portion of passage 15 and at least some of the remaining portion of passage 15 may be filled by snap-in 151 or some other appropriate mechanism.

5. Connecting Wires 16

Figure 4:
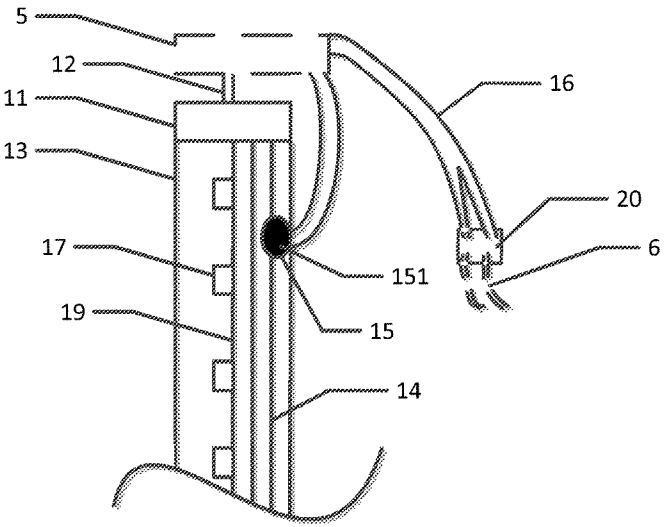
FIG. 4 is a partial side view of an LED lamp tube according to various embodiments, as installed in a light fixture.

As shown in FIG. 4, the electrical connecting wires 16 may be comprised of two or more wires, in various embodiments. In some embodiments, the electrical connecting wires 16 may be wrapped such that they form a single cable, as is well understood in the art. In some embodiments, the wires may be stranded wires. In other embodiments, other types of wire may be used. In some embodiments, 1-1.5 feet of the electrical connecting wires 16 may be disposed outside of the LED lamp tube 10. In other embodiments 0.5-1.25 feet of the electrical connecting wires 16 may be disposed outside of the LED lamp tube 10. In still other embodiments, 1.25-2 feet of the electrical connecting wires 16 may be disposed outside of the LED lamp tube 10. In certain embodiments, more than 2 feet of the electrical connecting wires 16 may be disposed outside of the LED lamp tube 10. In certain other embodiments, less than 0.5 feet of the electrical connecting wires 16 may be disposed outside the LED lamp tube 10 as long as enough wire is provided to electrically connect the electrical connecting wires 16 to the line voltage wires 6.

Figure 5:
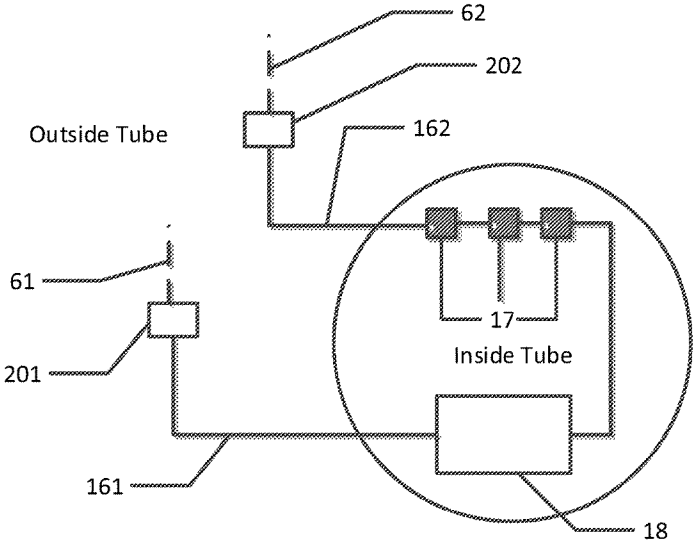
FIG. 5 is a schematic wiring diagram of an LED lamp tube according to various embodiments in electrical connection to line voltage.
Figure 13B:
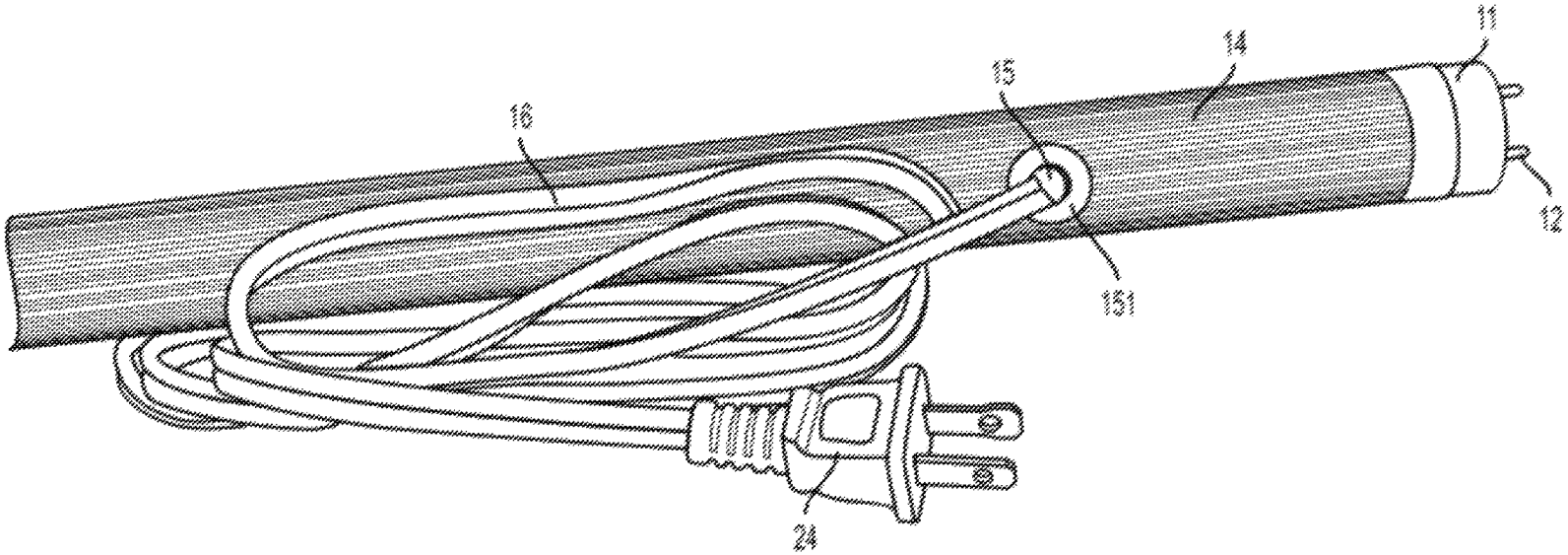
FIG. 13B is a perspective view of an LED lamp tube with electrical connecting wires terminating with a self-contained 2-prong polarized plug, according to various embodiments of the present invention.
Figure 14:
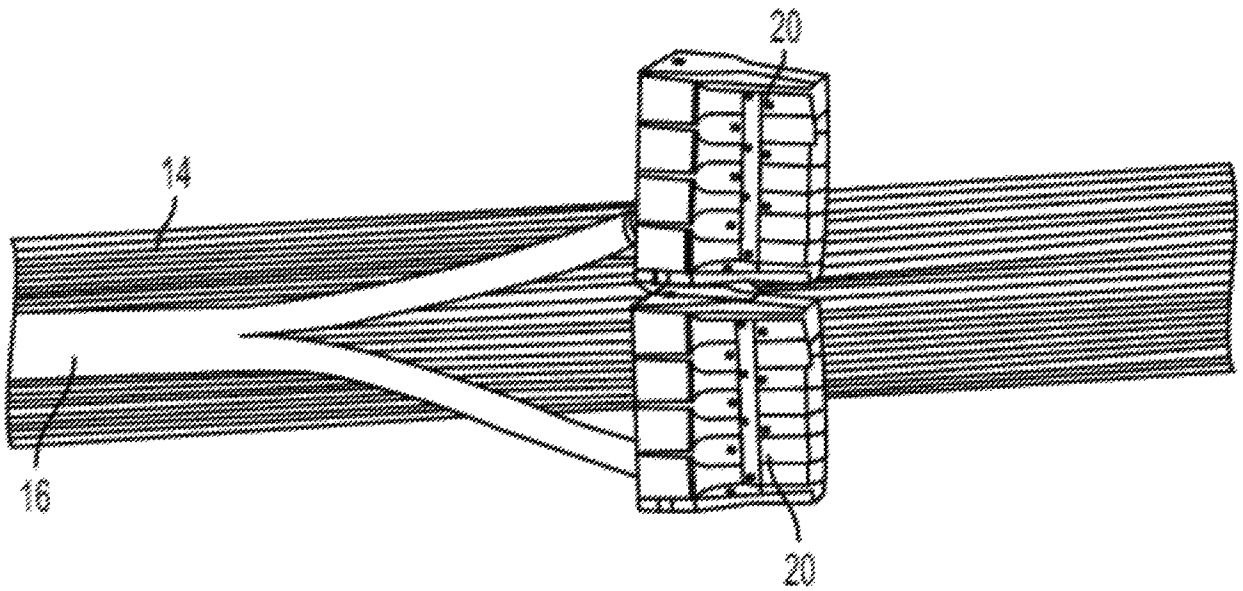
FIG. 14 is a closer side view of the quick connect connector, which is secured to the ends of electrical connecting wires, according to various embodiments of the present invention.

As schematically shown in FIG. 5, in various embodiments, the first end of each of the electrical connecting wires 16 is connected to the driver circuitry 18, which is described below. In various embodiments, the second end of the electrical connecting wires 16 may be stripped and may be tin coated. As shown in FIGS. 13A, 13B, 14, and 15, in various embodiments, the second end of the electrical connecting wires 16 are connected to a quick connect connector, or some other style quick connect connector 20, which may then be used to connect the electrical connecting wires 16 to line voltage wires 6. The quick connect connector 20 used in some embodiments may be one of several types of quick connect connectors sold by WAGO, as may be particularly understood from FIG. 13A. In other embodiments, the second end of the electrical wires 16 are configured to be inserted into a quick connect connector 20, which may then be used to connect electrical connecting wires 16 to line voltage wires 6. As shown in FIG. 13B, in various embodiments the electrical connecting wires 16 may also be connected to a 2-prong polarized plug 24. In other embodiments, a 3-prong polarized plug may be used. In such embodiments, it may be understood the plug 24 may be configured for connection directly into a lone voltage plug-in receptacle, as such are commonly known and understood in the art. FIG. 6 illustrates at least one embodiment where the ends of electrical connecting wires 16 have been stripped and are configured to be inserted into a WAGO connector or other quick connect connector. In still other embodiments, the second end of the electrical connecting wires 16 are configured to be connected to line voltage in some other manner. Thus, the electrical connecting wires 16 connect the electrical circuitry of the LED lamp tube 10 to line voltage.

6. Light Emitting Diode (LED) 17

Returning to FIG. 1, LED lamp tube 10 also comprises at least one light emitting diode (LED) 17. In various embodiments, LED lamp tube 10 comprises 360 or more LEDs 17. In different embodiments, the LEDs 17 may have different wattages and/or different color temperatures. In various embodiments, the one or more LEDs 17 may be placed such that they create a single line down the middle of the lamp tube. In other embodiments, the one or more LEDs 17 may be placed in various configurations within the lamp tube. One non-limiting example is that the LEDs 17 may be arranged in two lines which are offset from each other, such as illustrated in FIG. 7. Also, various embodiments of the LED lamp tube 10 may employ LEDs 17 that emit different levels of illumination at different color temperatures. The number of LEDs 17 used may also be utilized to determine the level of illumination emitted by the lamp tube 10.

Figure 2:
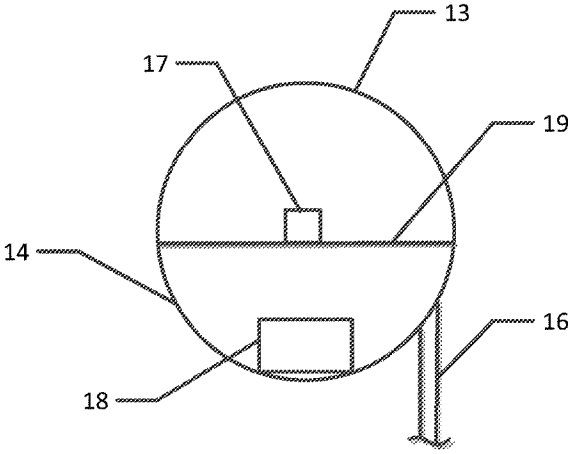
FIG. 2 is a cross-sectional view according to various embodiments of the LED lamp tube.

The LEDs are mounted on reflective back plate 19 by any of various methods generally known and understood in art. As shown in FIG. 2, in various embodiments, reflective back plate 19 may be disposed along a diameter of the cross-section of LED lamp tube 10. Thus, in certain embodiments, reflective back plate 19 may divide the tube into two chambers of nearly equal volume. In other embodiments, the two chambers may not have nearly equal volumes. In various embodiments, the reflective back plate 19 additionally permits the wiring of the LED lamp tube 10 to be hidden from the view of the user, providing a more aesthetically pleasing lamp tube.

As illustrated in FIG. 6, in various embodiments, the surface of reflective back plate 19 upon which the LEDs 17 are mounted may be coated with a reflective material or coating, ensuring that a significant fraction of the light emitted by the LEDs 17 is transmitted through lens 13, by minimizing the light absorbed by reflective back plate 19. Thus, in various embodiments, at least a portion of the light that may be emitted by the LEDs 17 toward the reflective back plate 19 or that has reflected off the inside surface of lens 13 back toward the reflective back plate 19 may be reflected off reflective back plate 19 toward lens 13. In other embodiments, the reflective back plate 19 may be configured such that a significant fraction of the light incident upon the reflective back plate 19 is reflected toward the lens 13. In certain embodiments, the reflective back plate 19 may be configured such that substantially all of the light incident upon the reflective back plate 19 is reflected toward the lens 13.

7. Driver Circuitry 18

As illustrated in FIG. 2, driver circuitry 18 is disposed within the body of LED lamp tube 10. In various embodiments, the driver circuitry 18 may comprise a circuit portion configured to convert the input alternating current (AC) line voltage to a direct current (DC) voltage. In various embodiments, the driver circuitry 18 may comprise a circuit portion configured to control the current being applied to the LEDs 17. The driver circuitry 18, in various embodiments, may further comprise a circuit portion configured to allow a user to adjust the brightness of the light emitted from the LED lamp tube 10 through the use of a dimmer switch. These circuitry portions are commonly known and understood in the art, and thus will not be described in detail herein. In various embodiments, the driver circuitry 18 may include other circuitry portions and/or the circuitry portions described herein may not be distinct circuitry portions. For example, in some embodiments, the circuitry portion that converts the AC line voltage to a DC voltage may also control the current being applied to the LEDs 17.

In various embodiments, the driver circuitry 18 is disposed within the chamber defined by the back cover 14 and reflective back plate 19. In some embodiments, the driver circuitry may be mounted on the back cover 14, as shown in FIG. 2. In other embodiments, the driver circuitry may be mounted on the reflective back plate 19. In still other embodiments, the driver circuitry may be mounted in an end cap 11 disposed on an end of LED tube lamp 10. In certain embodiments, some components of the driver circuitry 18 may be mounted to the reflective back plate 19 while other components of the driver circuitry 18 may be mounted to the back cover 14. In some embodiments, driver circuitry is located on one end of the LED lamp tube 10, possibly the same end of LED lamp tube 10 as the passage 15. In other embodiments, driver circuitry 18 may be centered along the length of LED lamp tube 10 or in some other location within the LED lamp tube 10.

Figure 3:
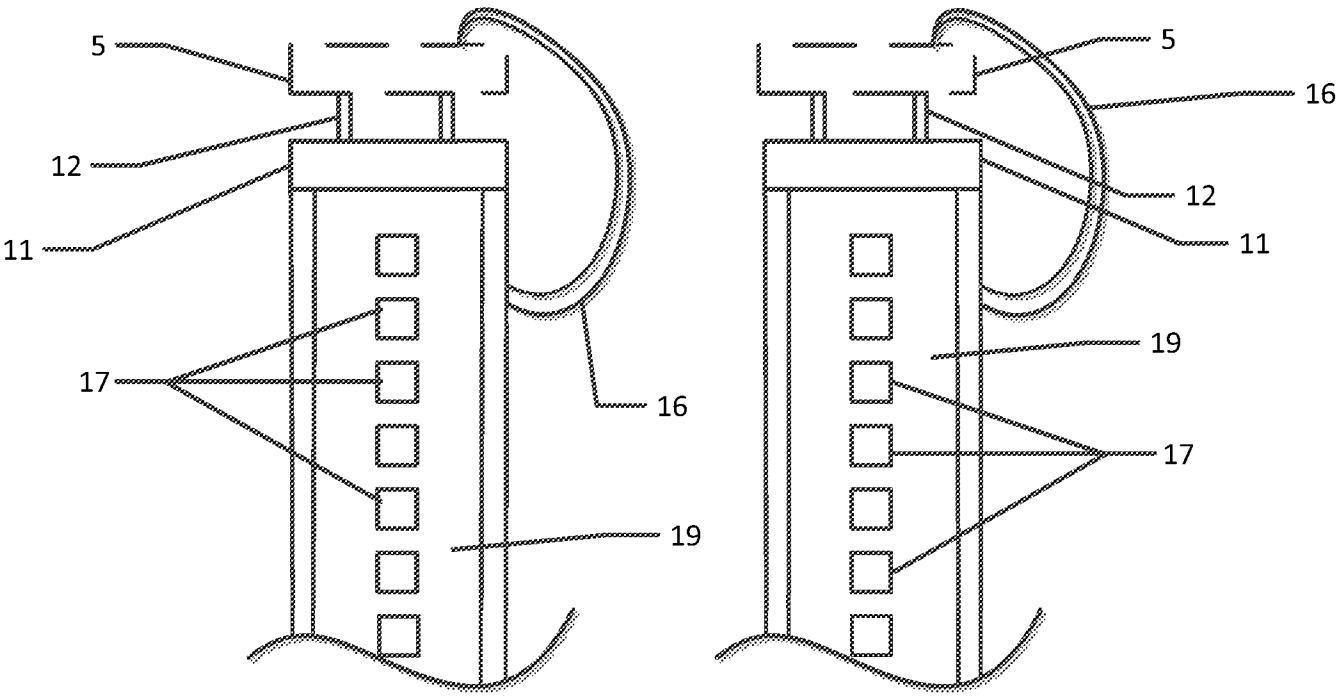
FIG. 3 is a partial front view of two LED lamp tubes according to various embodiments, as installed in a light fixture.

FIG. 3 illustrates two LED lamp tubes 10 installed into an existing fluorescent light fixture. The pins 12 may mechanically connect the LED lamp tubes 10 to the tombstones 5 of the light fixture. However, in the illustrated embodiment, the pins 12 do not electrically connect the driver circuitry 18 to the tombstones 5. Thus, electrical connecting wires 16 pass through the passage 15 in each of the bodies of the LED lamp tubes 10. In various embodiments, the electrical connecting wires 16 may be passed through a knock-out in the tombstone 5 and then connected to line voltage wires 6. In certain embodiments, the knock-out may be created by drilling a hole through the tombstone 5 or other component of the lighting fixture, if such does not previously exist.

As illustrated in FIG. 3, lighting fixtures configured for lamp tubes tend to be designed to hold more than one lamp tube. In various embodiments, the plurality of LED lamp tubes 10 installed in a lighting fixture may be wired independently of each other, at least in part because the driver circuitry 18 is mounted inside the LED tube lamp 10. Thus, in various such embodiments, each LED tube lamp 10 may be controlled by the driver circuitry 18 mounted within the LED tube lamp 10. Therefore, each LED tube lamp 10 may be controlled independently of the other LED tube lamps 10 mounted within the same lighting fixture.

8. Connector 20

As shown in FIG. 4, the electrical connecting wires 16 may be attached to one or more quick connect connectors 20. In some embodiments, quick connect connector 20 is configured to receive line voltage wires 6. In other embodiments, line voltage wires 6, may be connected to a quick connect connector 20 which is configured to receive electrical connecting wires 16. In various embodiments, quick connect connectors 20 are configured to easily and securely electrically connect electrical connecting wires 16 with line voltage wires 6. In some embodiments, quick connect connector 20 may be a WAGO 773 style quick connect connector. In other embodiments, quick connect connector 20 may be a different style quick connect connector. The positive and negative electrical connecting wires 16 may be electrically connected to the positive and negative line voltage wires 6, respectively, using one or more quick connect connectors 20. The use of quick connect connector 20 in various embodiments simplifies the installation of LED lamp tube 10 into a lighting fixture, as will be described in further detail herein below FIG. 5 provides a schematic representation of the wiring of an installed LED lamp tube 10. Electrical power is provided by a first line voltage wire 61. A first electrical connection between the first line voltage wire 61 and the first electrical connection wire 161 is made using a first quick connect connector 201. The first electrical connection wire 161 provides power to the driver circuitry 18. The output of the driver circuitry 18 is fed to one or more LEDs 17 which may be connected in series or in parallel. The LEDs 17 the use the electrical power to emit light. The electrical circuit is closed through a second electrical connection wire 162 which is in electrical connection with the second line voltage wire 62 via the second quick connect connector 202. The first quick connect connector 201 and the second quick connect connector 202 may be different bays of quick connect connector 20 or may be two different quick connect connectors 20. FIG. 5 is provided to merely illustrate the basic concept of how the installed LED lamp tube 10 is powered. Additional circuitry and wiring not discussed here may be employed in the LED tube lamp 10 in keeping with the present invention.

Figure 16:
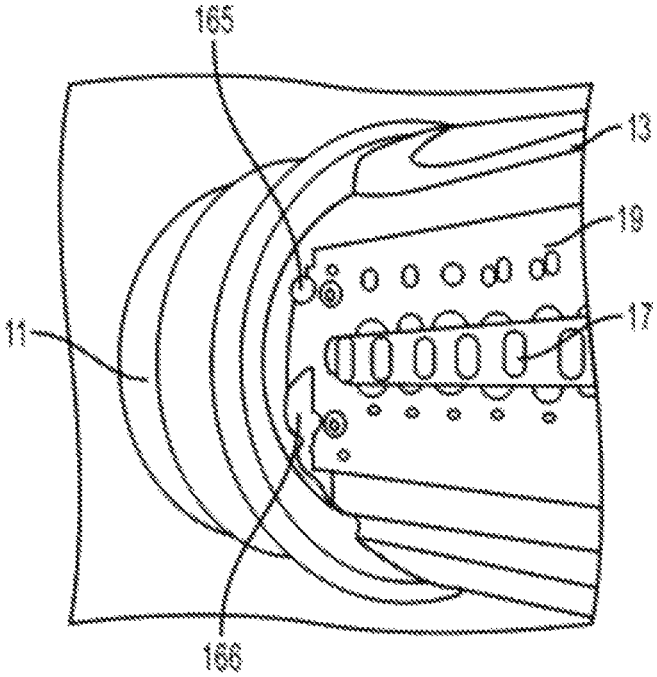
FIG. 16 is a perspective top view of a first end of an LED lamp tube according to various embodiments of the present invention.

FIG. 16 shows how the driver circuitry 18 is electrically connected to the LEDs 17. Positive interior electrical wire 165 is visible coming up from the chamber defined by the back cover 14 and the reflective back plate 19 and soldered onto an electrical contact point on reflective back plate 19. Positive interior electrical wire 165 is colored red and, on the reflective back plate 19, is marked "+V" in this embodiment. Thus, in this embodiment, positive interior electrical wire 165 electrically connects the driver circuitry 18 to the LEDs 17. Negative interior wire 166 is also visible coming up from the chamber defined by the back cover 14 and the reflective back plate 19 and is soldered onto an electrical contact point on reflective back plate 19. In this embodiment, negative interior wire 166 is colored black and is labeled, on the reflective back plate 19, as "−V". Thus, in this embodiment, negative interior electrical wire 166 electrically connects the LEDs to the second electrical connection wire 162 so that the electrical circuit can be completed.

Various embodiments of LED lamp tube 10 are configured to satisfy various safety standards such as UL Standards and other relevant standards. For example, various embodiments of the LED lamp tube 10 satisfy UL 1598C standards. Other embodiments of the LED lamp tube 10 may satisfy other relevant safety standards.

Exemplary Methods of Installing Various Embodiments

The process of installing an LED lamp tube 10 into a lighting fixture will be detailed below. Various embodiments of an LED lamp tube 10 may be installed into a variety of lighting fixtures commonly known and understood in the art for use with various lamp tubes. The process detailed below is especially relevant to the installation of an LED lamp tube 10 in an existing fluorescent lamp tube lighting fixture, as illustrated in FIGS. 3 and 4.

In various embodiments, to install an LED lamp tube 10 into a lighting fixture, user may remove any cover present on the lighting fixture. The user may then remove any lamp tubes present in the lighting fixture that the user wishes to replace with an LED tube lamp 10. In various embodiments, a cover may not be present on the lighting fixture and/or there may not be a lamp tube present in the lighting fixture in the position in which the user wishes to install the LED tube lamp 10.

In various embodiments, the user may remove the pin protectors 22, if present, from the pins 12. The user may then insert the pins 12 of the LED lamp tube 10 into the tombstones 5 of the lighting fixture or other lighting fixture component configured to receive the pins 12, using any of a variety of appropriate methods commonly known for installing a fluorescent lamp tube into a lighting fixture.

The user may pass through electrical connecting wires 16 through a punch out in tombstone 5, in various embodiments. In other embodiments, the electrical connecting wires 16 may be passed through a knock out or passage to the back of the lighting fixture. In still other embodiments, a hole may be drilled through tombstone 5 in order to create a knockout or a passage through which electrical connecting wires 16 maybe be passed. In yet other embodiments, the electrical connecting wires 16 need not be passed through to the back of the lighting fixture. In some embodiments, a user may pass through the electrical connection wires 16 through a knock out or passage before inserting the pins 12 into the tombstones 5 or other pin receiving component.

Next, the user may connect the electrical connecting wires 16 to line voltage wires 6. In various embodiments, this step may be completed by inserting and securing the ends of the electrical connecting wires 16 into the appropriate positions on one or more quick connect connectors 20. In some embodiments, the electrical connecting wires 16 may already be secured into a quick connect connector 20. In various embodiments, the user may now insert and secure the line voltage wires 6 into the appropriate positions on the one or more quick connect connectors 20. In some embodiments, the line voltage wires 6 may already be secured in one or more quick connect connectors 20. In various embodiments, the electrical connecting wires 16 may be connected to a two-prong polarized plug 24 or a three-prong polarized plug. In various embodiments, the user may now insert the two- or three-prong polarized plug into a line voltage plug-in receptacle to complete the electrical connection to the line voltage wires 6.

Once the electrical connection has been completed, the user may choose to replace another lamp tube in the same lighting fixture. If so, the user would repeat the relevant steps detailed above. Once the user has completed installing the LED lamp tubes 10 that the user wishes to install into the lighting fixture, the user may replace any cover removed from the lighting fixture.

In various embodiments, a user may wish to install two or more LED lamp tubes 10 in series. If one of the LED lamp tubes 10 becomes non-operational, the remaining LED lamp tubes 10 may not be affected because each LED lamp tube 10 is controlled by its own driver circuitry 18. In various such embodiments, the user would complete steps similar to those detailed above to install the plurality of LED lamp tubes 10.

Remaining with FIGS. 3 and 4, to install a plurality of LED lamp tubes 10 in series, according to various embodiments, the user would again remove any cover from the lighting fixture and remove any lamp tubes that the user wishes to replace with LED lamp tubes 10. The user would then remove any pin covers 22 that may be present. The user may then insert the pins of the first LED lamp tube 10 into the tombstones 5 or other pin receiving component of the lighting fixture. The user may then pass the electrical connection wires 16 through a knockout, passage, or hold drilled through the tombstone 5 or other component of the lighting fixture. The electrical connection wires 16 may then be connected to the line voltage wires 6. In various embodiments, the electrical connection may be made by inserting and securing the electrical connection wires 16 and/or the line voltage wires 6 into one or more quick connect connectors 20.

In various embodiments, the user would then insert the pins of the second LED lamp tube 10 into the tombstones 5 or other pin receiving component of the lighting fixture. The user may then pass the second electrical connection wires 16 through a knockout, passage, or a hole drilled through tombstone 5 or other component of the lighting fixture. The electrical connection wires 16 may then be connected to the line voltage wires 6. In various embodiments, the electrical connection may be made by inserting and securing the electrical connection wires 16 and/or the line voltage wires 6 into one or more quick connect connectors 20 or by inserting the two- or three-prong polarized plug into a line voltage plug-in receptacle. These steps may be repeated until the user has installed the plurality LED lamp tubes 10.

In various embodiments, the user may elect to mechanically connect the plurality of LED lamp tubes 10 to the lighting fixture and then electrically connect the plurality of LED lamp tubes to the line voltage wires 6. In other embodiments, the user may elect to electrically connect the plurality of LED lamp tubes 10 to the lighting fixture and then mechanically connect the plurality of LED lamp tubes 10 to the lighting fixture.

Figure 15:
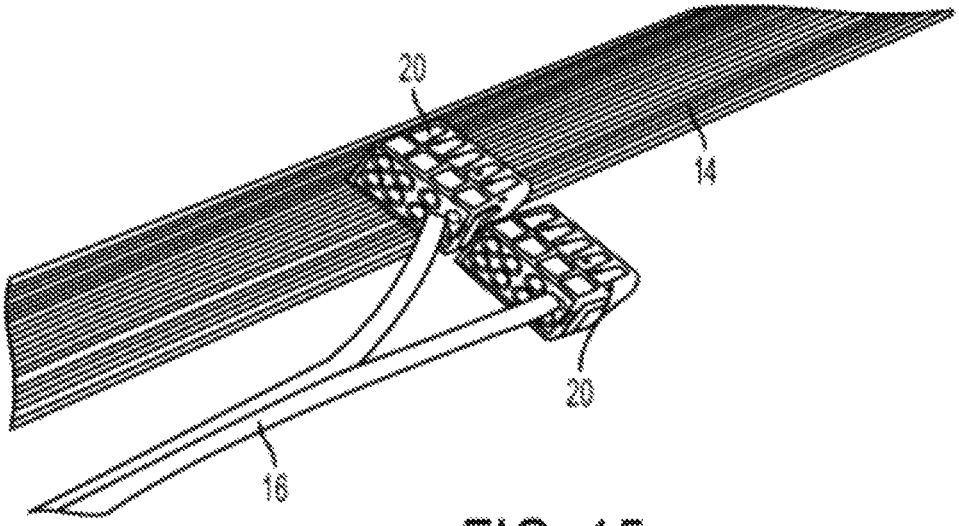
FIG. 15 is a perspective view of the electrical connecting wires inserted into a quick connect connector, according to various embodiments of the present invention.

In various embodiments, one quick connect connector 20 may be used to at least in part electrically connect more than one LED lamp tube 10 to the line voltage wires 6. As illustrated in FIG. 15, a quick connect connector 20 may be configured to connect one or more LED lamp tubes 10 to line voltage wires 6, via the electrical connecting wires 16. As illustrated in FIG. 13B, in still other embodiments, a self-contained 2- or 3-prong polarized plug may also be incorporated and used to connect one or more LED lamp tubes 10 to a line voltage plug-in receptacle.

CONCLUSION

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A light emitting diode (LED) lamp tube comprising:

a member comprising at least two surfaces defining, in part, an interior cavity of said member, wherein said member is sized to be mounted within a lighting fixture;

one or more LEDs;

at least one driver circuit positioned within said interior cavity and in electrical connection with said at least one LED; and one or more pins secured on each of said at least two surfaces, wherein at least a portion of each of said one or more pins is disposed external said interior cavity and configured to mechanically mount said LED lamp tube to said lighting fixture, and wherein each of said one or more pins is electrically isolated from said lighting fixture.

2. The LED lamp tube of claim 1, wherein said at least two surfaces comprise corresponding first and second end caps, and wherein said one or more pins are secured on at least one of said first and second end caps.

3. The LED lamp tube of claim 1, wherein said one or more pins are configured for mechanically mounting the LED lamp tube within at least one of a T8 and a T12 lighting fixture.

4. The LED lamp tube of claim 1, wherein said one or more pins are further electrically isolated from said at least one driver circuit.

5. The LED lamp tube of claim 1, further comprising a set of electrical connecting wires having a first end and second end, wherein said first end is in direct electrical communication with said at least one driver circuit and said second end is configured for connecting to line voltage.

6. The LED lamp tube of claim 5, wherein said at least one driver circuit is configured to receive line voltage from the set of electrical connecting wires and provide a controllable current to the at least one LED.

7. The LED lamp tube of claim 5, wherein said second end comprises either (a) a two- or three-prong polarized plug or (b) one or more quick connect connectors for connecting to line voltage.

8. The LED lamp tube of claim 1, wherein the one or more LEDs comprise a plurality of LEDs, said plurality of LEDs spaced along a length of said substantially elongate member.

9. The LED lamp tube of claim 1, wherein the one or more LEDs comprise at least two LEDs, at least one of the at least two LEDs configured to emit light of a first color temperature and another of the at least two LEDs configured to emit light of a second color temperature, wherein the first and second color temperatures are different.

10. The LED lamp tube of claim 1, wherein:

the member further comprises an intermediate surface, at least a portion of the intermediate surface being made of a transparent or translucent material; and at least one of said one or more LEDs are positioned such that at least a portion of the light emitted by the at least one of said one or more LEDs is incident upon the interior face of the portion of the intermediate surface.

11. The LED lamp tube of claim 1, wherein said at least one driver circuit is configured to convert line voltage to a controlled DC voltage.

12. The LED lamp tube of claim 1, wherein said member is elongate in shape.

13. A lighting device comprising:

one or more LED lamp tubes, wherein each LED lamp tube comprises:

a member comprising at least two surfaces defining, in part, an interior cavity of said member, wherein said member is sized to be mounted within the lighting device;

one or more LEDs;

at least one driver circuit positioned within said interior cavity and in electrical connection with said at least one LED; and one or more pins secured on each of said at least two surfaces, wherein at least a portion of each of said one or more pins is disposed external said interior cavity and configured to mechanically mount each of said LED lamp tube to said lighting device, and wherein each of said one or more pins is electrically isolated from said lighting device.

14. The lighting device of claim 13, further comprising a set of electrical connecting wires having a first end and second end, wherein said first end is in direct electrical communication with said at least one driver circuit and said second end comprises either (a) a two- or three-prong polarized plug or (b) one or more quick connect connectors for connecting to line voltage.

15. The lighting device of claim 13, wherein a current provided to the one or more LEDs of each LED lamp tube may be controlled by the at least one driver circuit of the corresponding LED lamp tube.

16. The lighting device of claim 15, wherein the lighting device comprises a first LED lamp tube and a second LED lamp tube and the first current provided to the one or more LEDs of the first LED lamp tube is controlled independently of the second current provided to the one or more LEDs of the second LED lamp tube.

17. The lighting device of claim 13, wherein said at least two surfaces of each LED lamp tube comprise corresponding first and second end caps, and wherein said one or more pins are secured on at least one of said first and second end caps.

18. The lighting device of claim 13, wherein said one or more pins are further electrically isolated from said at least one driver circuit.

19. The lighting device of claim 13, further comprising one or more tombstones configured to mechanically mount the one or more LED lamp tubes by said at least one pin, wherein said one or more tombstones are electrically isolated from line voltage.

20. The lighting device of claim 13, wherein the one or more LEDs are positioned within said interior cavity.

* * * * *